US006644373B2

(12) United States Patent
Palmer

(10) Patent No.: US 6,644,373 B2
(45) Date of Patent: Nov. 11, 2003

(54) CORDLESS BLIND

(75) Inventor: Roger C. Palmer, Greensboro, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 46 days.

(21) Appl. No.: 10/008,290

(22) Filed: Nov. 8, 2001

(65) Prior Publication Data

US 2003/0085002 A1 May 8, 2003

(51) Int. Cl.[7] ..... E06B 9/30
(52) U.S. Cl. ..... 160/168.1 R; 160/192
(58) Field of Search ..... 160/168.1 R, 173 R, 160/170 R, 84.06, 405, 191, 192

(56) References Cited

U.S. PATENT DOCUMENTS

| | | | | |
|---|---|---|---|---|
| 1,669,255 A | | 5/1928 | Landy | |
| 1,721,501 A | | 7/1929 | McKee | |
| 2,420,301 A | | 5/1947 | Cusumano | |
| 2,609,193 A | | 9/1952 | Foster | |
| 3,280,890 A | * | 10/1966 | Presiosi | 160/168.1 R |
| 3,795,267 A | | 3/1974 | Debs | 160/168 |
| 4,574,864 A | | 3/1986 | Tse | |
| 4,687,038 A | | 8/1987 | Clemente | 160/84 R |
| 4,886,102 A | | 12/1989 | Debs | 160/177 |
| 5,054,162 A | | 10/1991 | Rogers | |
| 5,133,399 A | | 7/1992 | Hiller et al. | 160/171 |
| 5,170,830 A | | 12/1992 | Coslett | |
| 5,184,660 A | | 2/1993 | Jelic | 160/171 |
| 5,477,904 A | * | 12/1995 | Yang | 160/84.06 X |
| 5,482,100 A | | 1/1996 | Kuhar | 160/170 |
| 5,531,257 A | | 7/1996 | Kuhar | 160/168.1 |
| 5,533,559 A | | 7/1996 | Judkins | 160/84.06 |
| 5,996,668 A | | 12/1999 | DeBlock et al. | 160/107 |
| 6,003,584 A | * | 12/1999 | Weinreich | 160/170 R |
| 6,012,506 A | | 1/2000 | Wang et al. | 160/170 |
| 6,029,734 A | | 2/2000 | Wang et al. | 160/170 R |
| 6,044,889 A | | 4/2000 | Liu | 160/172 R |
| 6,283,192 B1 | * | 9/2001 | Toti | 160/170 R |
| 6,293,329 B1 | * | 9/2001 | Toti | 160/170 R X |
| 6,330,899 B1 | * | 12/2001 | Ciuca et al. | 160/170 R |
| 2002/0033241 A1 | | 3/2002 | Palmer | 160/170 |

FOREIGN PATENT DOCUMENTS

| | | |
|---|---|---|
| EP | 0 534 261 | 3/1993 |
| EP | 0 674 091 | 9/1995 |
| FR | 883 709 | 7/1943 |
| FR | 2 337 809 | 8/1977 |
| WO | WO 92/09779 | 6/1992 |

OTHER PUBLICATIONS

International Search Report, International Application No. PCT/US02/35836, mailed Jan. 24, 2003.

F.A. Votta, The Theory and Design of Long–Deflection Constant–Force Spring Elements, Transactions of the Asme, May 1952, pp. 439–450.

* cited by examiner

*Primary Examiner*—David Purol
(74) *Attorney, Agent, or Firm*—Marshall, Gerstein & Borun LLP

(57) ABSTRACT

A window covering system comprises a plurality of slats located between a head rail and a bottom rail. The bottom rail is connected to the head rail by a pair of lifting cords extending through the slats. A first spring motor and storage device is located in one of the head rail and the bottom rail. The first spring motor and storage device includes at least one extension spring having a first end that is fixedly secured in the head rail or bottom rail and a second end that is free to move within the head rail or bottom rail. At least one of the lifting cords is looped around the free end of at least one of the extension springs so that movement of the bottom rail in a vertical direction causes a corresponding movement in the second end of the extension spring in a direction along the longitudinal axis of the head rail or bottom rail. A method for balancing a window covering system using a pair of extension springs is also disclosed.

22 Claims, 9 Drawing Sheets

FIG. 13
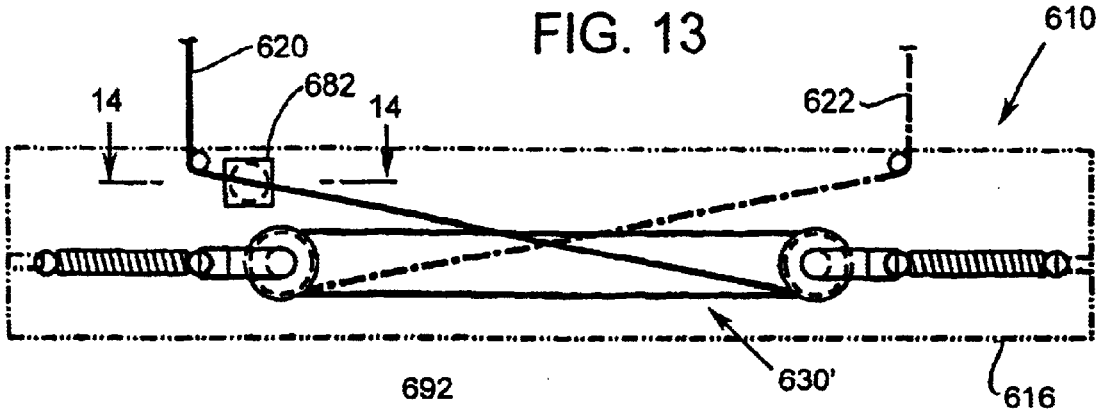
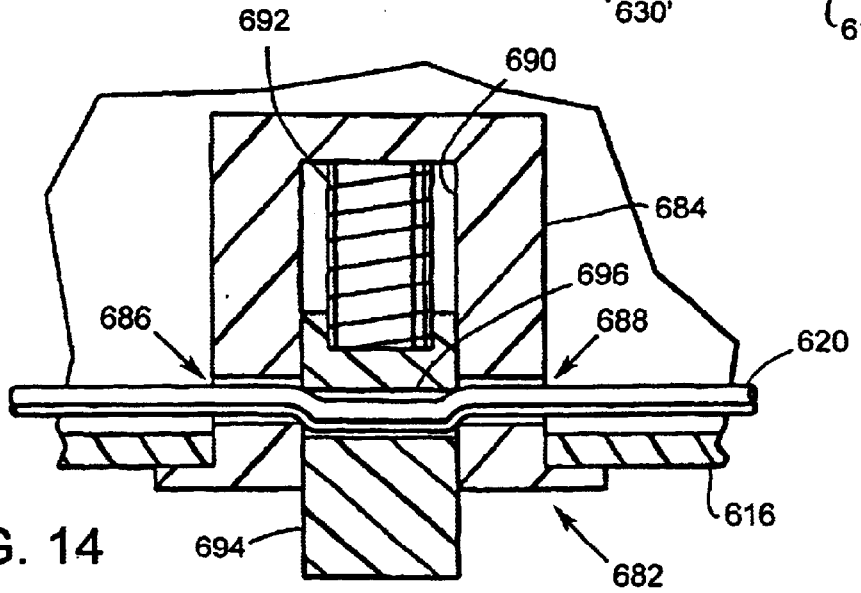
FIG. 14
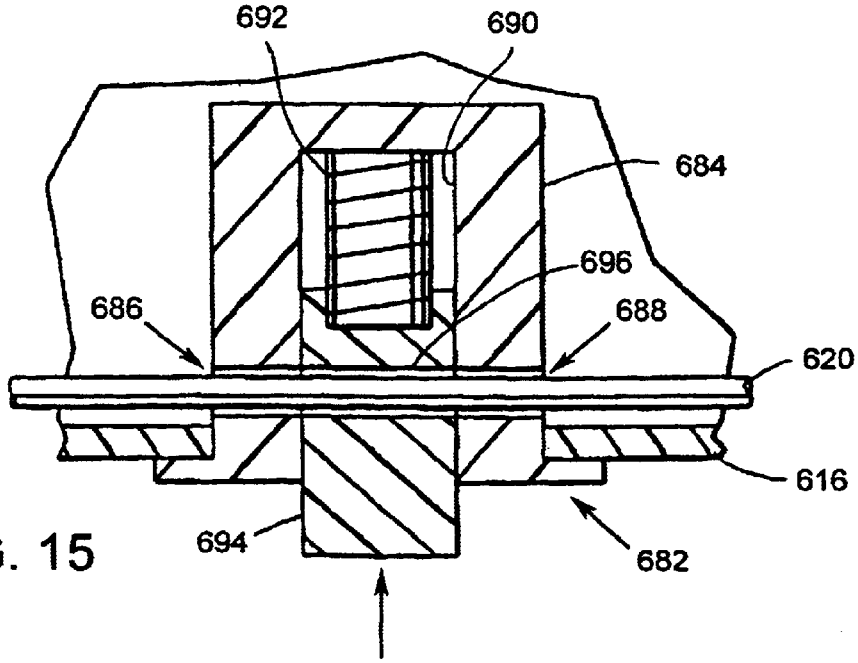
FIG. 15

CORDLESS BLIND

FIELD OF THE INVENTION

The present invention relates to a system in which outer lifting cords are eliminated from blinds or shades. More specifically, the present invention relates to window covering systems which employ one or springs to balance the weight of window covering material and to accumulate the lifting cord within the head rail and/or bottom rail as the blind or shade is raised or lowered.

BACKGROUND OF THE INVENTION

Venetian blinds have known for many years and typically include a plurality of slats made from metal, plastic, wood or other materials and supported by ladders. FIG. 1 shows a conventional venetian blind system 10 that includes a plurality of slats 12 located between a head rail 14 and a bottom rail 16. Prior art blind system 10 typically include a tilt mechanism 18 so that slats 12 can be moved from a horizontal position to a nearly vertical position to control the amount of light passing therethrough. As also conventional, blind system 10 includes lifting cords 20 and 22 which are coupled to the bottom rail, pass upwardly through the slats and into mechanisms within the head rail 14, and terminate in an exposed cord loop 24 outside the blind or shade. The lifting cord is so exposed to facilitate pulling of the outer pull cord 24 by hand, which in turn raises or lowers the bottom rail and any accumulated slats. Because of the natural tendency of the bottom rail and accumulated slats to free fall, locking mechanisms 25 are also commonly employed with such prior art blind systems.

Similar lift cord systems are used in a variety of the "soft" window products which are currently popular, including window coverings having pleated fabric between the head rail and the bottom rail, window coverings which have cellular fabric material between the head rail and the bottom rail, light control products which include cells having opaque portions arranged between the bottom rail and the head rail for light control and the like.

Systems are also known wherein the lift cords do not exit the head rail at all. Such systems are shown in Kuhar U.S. Pat. No. 6,234,236, issued May 22, 2001, U.S. Pat. No. 6,079,471, issued Jun. 27, 2000, U.S. Pat. No. 5,531,257, issued Jul. 2, 1996, and U.S. Pat. No. 5,482,100, issued Jan. 9, 1996. These systems use spring motors to balance the weight of the bottom rail and accumulating window covering material as the window covering is raised or lowered by simply grasping the bottom rail and urging it upwardly or downwardly.

Other patents show various spring devices used with venetian blinds. For example, in Cohn's U.S. Pat. No. 2,390,826, issued Dec. 11, 1945 for "Cordless Venetian Blinds," two coil springs are used to provide even force, with a centrifugal pawl stop. The blind is raised by freeing the pawl to allow the spring to provide a lift assist. Other more conventional systems employing springs and ratchet and pawl mechanisms include those shown in Etten's U.S. Pat. No. 2,824,608, issued Feb. 25, 1958 for "Venetian Blind"; U.S. Pat. No. 2,266,160, issued Dec. 16, 1941 to Burns for "Spring Actuated Blind"; and U.S. Pat. No. 2,276,716, issued Mar. 17, 1942 to Cardona for "Venetian Blind."

It would be desirable to provide a cordless window covering system with an inexpensive and simple cordless mechanism.

SUMMARY OF THE INVENTION

The present invention features a cordless blind system which employs one or more linearly shaped springs (i.e., an extension or compression spring) to balance the weight of window covering material and to accumulate the lifting cord within the head rail and/or bottom rail. The present invention further features a system which is easy to adapt to a wide variety of blind designs and sizes and has the capability of applying spring forces in a variety of ways and combinations.

According to a first aspect of the present invention, a window covering system comprises a plurality of slats located between a head rail and a bottom rail. The bottom rail is connected to the head rail by at least one lifting cord. At least one first biasing devices is located in one of the head rail and the bottom rail. The at least one first biasing devices has a fixed end and a free end that is free to move in a direction along an axis of the head rail or bottom rail. The at least one lifting cord is operatively connected to the free end of the at least one of the first biasing device so that movement of the bottom rail causes a corresponding movement in the free end of the first biasing device in the direction of the axis of the head rail or bottom rail.

According to another aspect of the present invention, a window covering system comprises a plurality of slats located between a head rail and a bottom rail. The bottom rail is connected to the head rail by at least two lifting cords extending through the slats. A pair of first linear springs is located in one of the head rail and the bottom rail. The first linear springs has first ends anchored to an inner surface of the head rail or the bottom rail and second ends that are free to move within the head rail or the bottom rail. At least one of the lifting cords is operatively connected to the free end of at least one of the linear springs so that movement of the bottom rail causes a corresponding movement in the second end of the linear spring.

According to another aspect of the present invention, a window covering system comprises a plurality of slats located between a head rail and a bottom rail. The bottom rail is connected to the head rail by at least two lifting cords extending through the slats. A first spring motor and storage device is located in one of the head rail and the bottom rail. The first spring motor and storage device includes a linear spring having one end that is fixedly secured in the head rail or bottom rail and a second end that is free to move within the head rail or bottom rail. At least one of the lifting cords is operatively connected to the free end of at least one of the coil springs so that movement of the bottom rail causes a corresponding movement in the second end of the coil spring.

According to a further aspect of the present invention, a method for balancing a window covering system includes operatively connecting a fixed end of a linearly shaped spring to a non-movable anchor in a hear rail or bottom rail so that the fixed end remains stationary, an opposite free end of the linearly shaped spring being free to move toward and away from the fixed end. The method further includes operatively connecting the at least one lifting cord to the free end of the linear shaped spring so that movement of the bottom rail in a vertical direction causes a corresponding movement in the free end of the linearly shaped spring in a direction along an axis of the head rail or bottom rail.

These and other benefits and features of the invention will be apparent upon consideration of the following detailed description of preferred embodiments thereof, presented in connection with the following drawings in which like reference numerals are used to identify like elements throughout.

BRIEF DESCRIPTION OF THE DRAWINGS

FIG. 13 is a front elevation schematic representation of a bottom rail and slat lifting mechanism in accordance a sixth embodiment of the present invention.

FIG. 14 is an enlarged, horizontal sectional view of a cord brake shown in FIG. 13 taken along the line 14—14, the cord brake shown in the engaged position.

FIG. 15 is a similar view as FIG. 14 but with the cord brake shown in the disengaged position.

Figure 1:
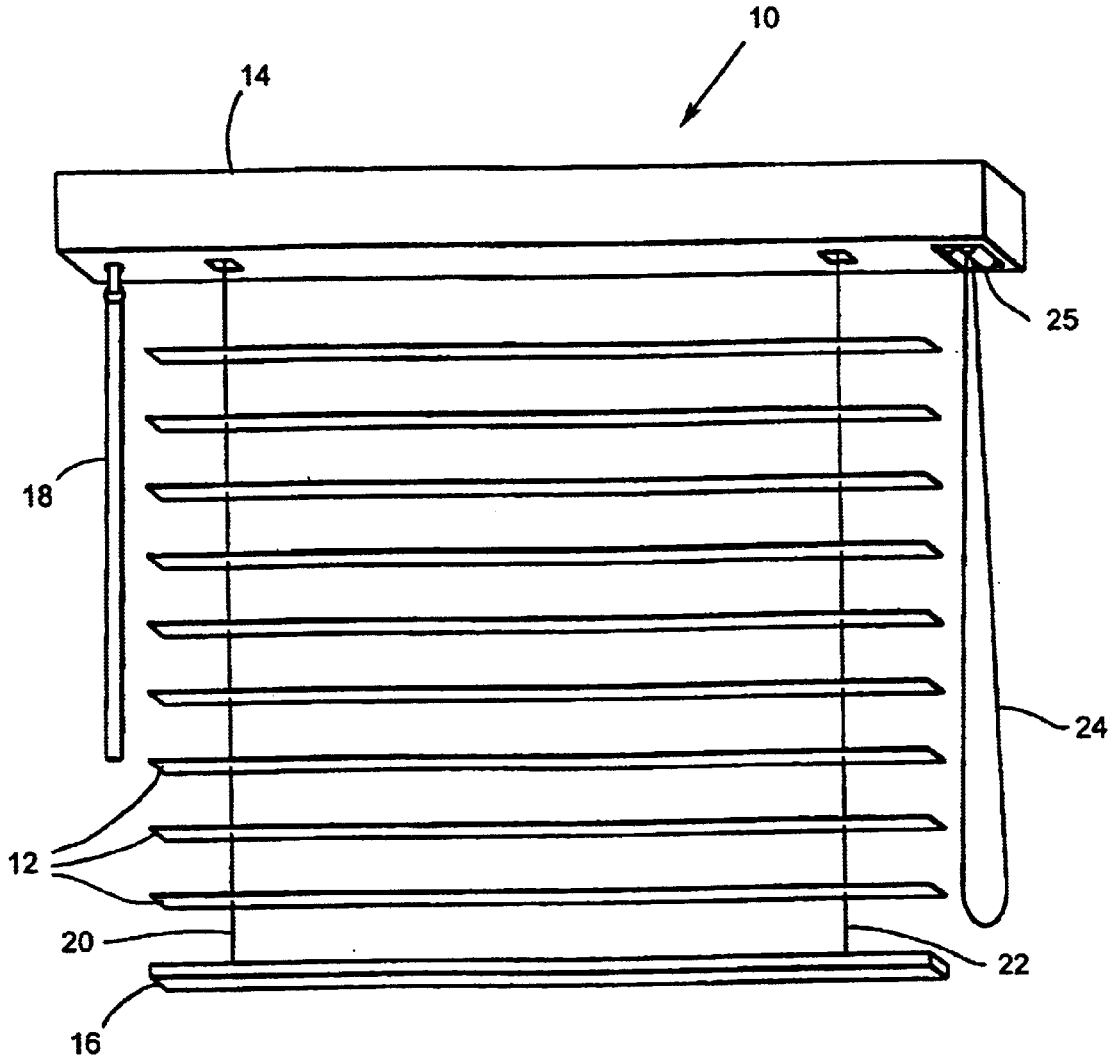
FIG. 1 is a perspective view of a conventional venetian blind in accordance with the prior art.

Before explaining at least one preferred embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
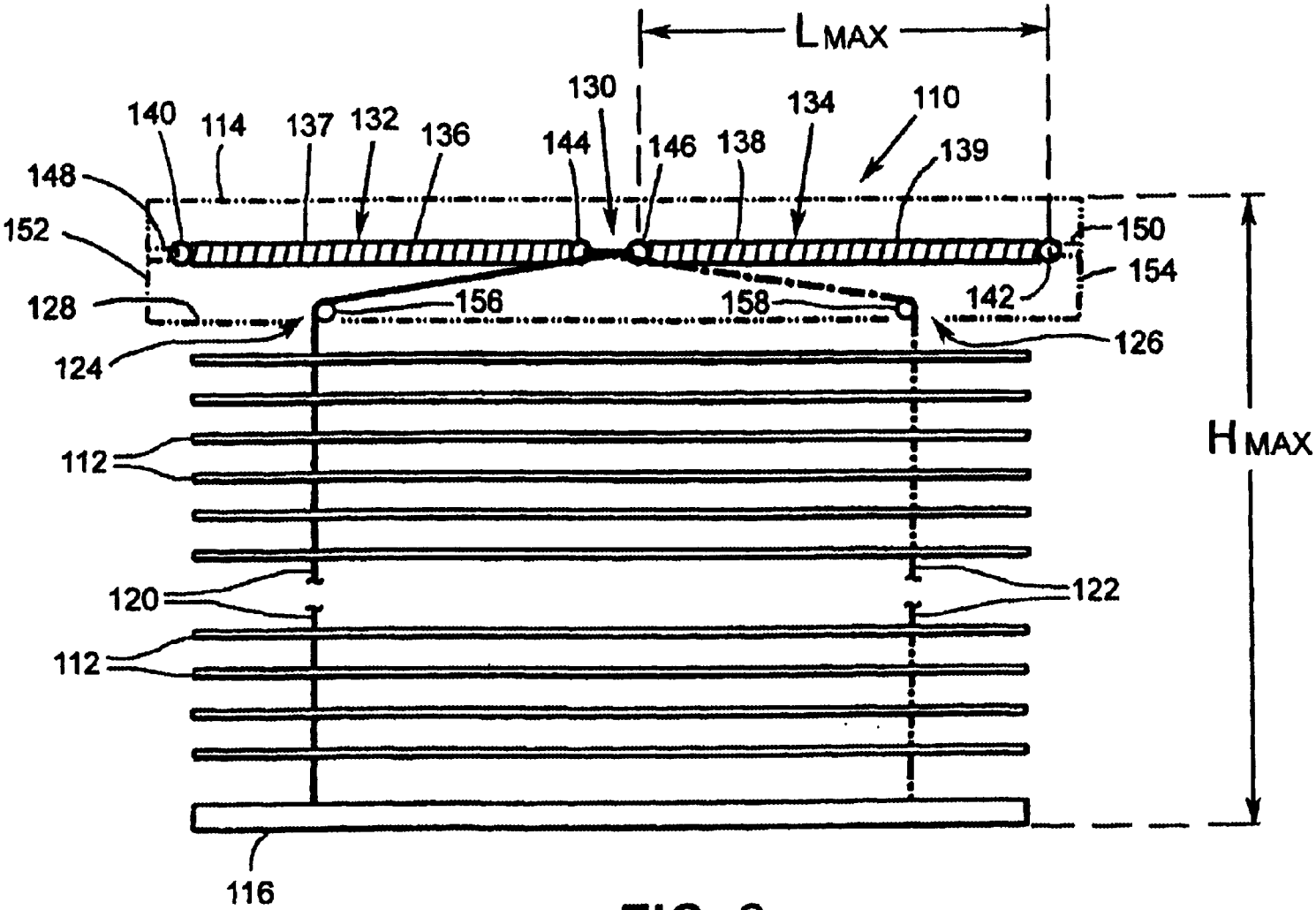
FIG. 2 is a front elevation schematic representation of a venetian blind and slat lifting mechanism in accordance a first embodiment of the present invention, with the blind shown in a closed position.
Figure 3:
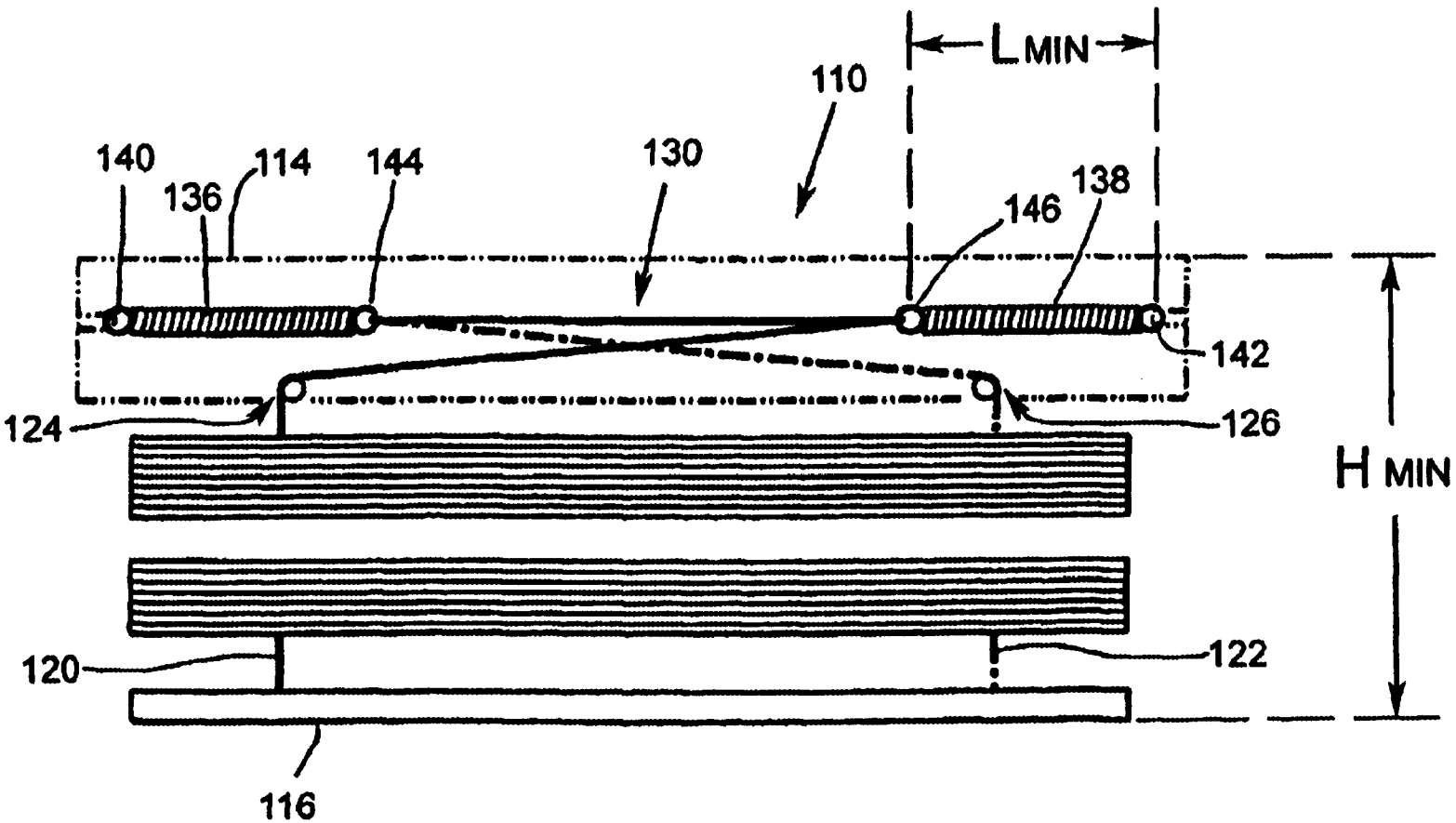
FIG. 3 is a front elevation schematic representation of the venetian blind and slat lifting mechanism of FIG. 2 with the blind shown in an open position.

Referring initially to FIGS. 2 and 3, a first embodiment of a blind system 110 in accordance with the present invention is shown in a fully lowered (closed) position (see FIG. 2) and a fully raised (open) position (see FIG. 3). For convenience, elements of blind system 110 that are substantially similar to corresponding elements of blind system 10 will be indicated by the same reference numerals but preceded by a "1".

Blind system 110 includes a plurality of slats 112 located between a head rail 114 and a bottom rail 116. When bottom rail 116 is in its fully lowered position (see FIG. 2), all the slats 112 are individually suspended from ladders (not shown) attached to head rail 114 and rotatable to different angles by a tilt mechanism (not shown) for selectively restricting the amount of light passing therethrough. The ladders and tilt mechanism are not illustrated in the FIGURES but are conventional and, in and of themselves, do not form part of the present invention.

Blind system 110 includes a pair of lifting cords 120 and 122 for raising and lowering bottom rail 116 and any accumulated slats 112. Cords 120 and 122 extend upwardly from bottom rail 116 through apertures formed in slats 112 and into head rail 114 via associated openings 124 and 126, respectively, formed in a bottom wall 128 of head rail 114. In head rail 114, cords 120 and 122 extend generally inwardly past each other as they proceed to a spring motor and storage unit 130.

Spring motor and storage unit 130 comprises a pair of elongated biasing devices 132 and 134 mounted in head rail 114. Each biasing device 132, 134 comprises a linearly shaped extension (or tension) spring 136, 138 having an elongated central portion 137, 139 terminated by a fixed (immovable) end 140, 142 and a free (movable) end 144, 146. Springs 136 and 138 are oriented with their central portions 137 and 139 generally in alignment with (i.e., parallel to) the central axes of head rail 114 and bottom rail 116. In addition, springs 136, 138 are oriented with their fixed ends 140 and 142 facing away from each other and their free ends 144 and 146 facing toward each other. The fixed ends 140 and 142 of springs 136 and 138 are connected to associated anchors 148 and 150, respectively, adjacent opposite end walls 152 and 154 of head rail 114 or at any other suitable location within head rail 114. The free ends 144 and 146 of springs 136 and 138 are slidably engaged with lift cords 122 and 120, respectively. When bottom rail 116 is fully lowered (see FIG. 2), blind system 110 will be at its maximum height $H_{MAX}$ and each spring 136, 138 will be at its maximum length $L_{MAX}$.

To open blind system 110, bottom rail 116 is manually urged toward head rail 114. When this occurs, slats 112 will begin to accumulate on bottom rail 16 and any resulting slack created in lifting cords 120 and 122 will be immediately taken up by spring motor and storage unit 130 as a result of the free ends 144 and 146 of springs 136 and 138 moving away from each other. When bottom rail 116 is fully raised (see FIG. 3), blind system 110 will be at its minimum height $H_{MIN}$ and each spring 136, 138 will be at its minimum length $L_{MIN}$. From FIGS. 2 and 3, it can be seen that the height of blind system 110 will always vary in a predetermined manner in relation to the length of each spring 136, 138.

In the embodiment of FIGS. 2 and 3, each cord 120, 122 is looped one time in spring motor and storage unit 130. In particular, cord 120 is looped once about free end 146 and cord 122 is looped once about free end 144. Cords 120 and 122 may be two portions of a single cord having its ends operatively coupled to bottom rail 116 or, alternatively, cords 120 and 122 may be separate cords connected together at a point between free ends 144 and 146 or secured to a fixed anchor in head rail 114 between free ends 144 and 146. In either case, any change in the height of blind system 110 resulting from bottom rail 116 being vertically urged from a first position to a second position will cause a corresponding change in the length of each spring 136, 138. In particular, this relationship can be described by the following equation:

$$H_1-H_2=2\times(L_1-L_2), \quad (1)$$

where $L_1$ is the spring length when bottom rail 116 is in the first position, $L_2$ is the spring length when bottom rail 116 is in the second position, $H_1$ is the blind height when bottom rail 116 is in the first position, and $H_2$ is the blind height when bottom rail 116 is in the second position. Thus, the length of each extension spring 136, 138 will change about ½ the amount of any change in the height of blind system 110.

Extension springs 136 and 138 should be selected to provide sufficient tension forces over their entire working range (i.e., between their expected maximum and minimum lengths) to support the weight of bottom rail 116 and any accumulated slats 112, taking into account any frictional forces in the system, so that bottom rail 116 does not free fall when released. However, extension springs 136 and 138 should not be selected to provide a tension force that is so strong that bottom rail 116 moves upwardly on its own accord when released. By selecting springs of the appropriate strengths and/or manipulating the frictional forces in blind system 110, the blind system can be properly balanced so that bottom rail 116 reliably remains in the position to which it is urged.

According to a well known equation known as Hooke's law, the force that an extension spring exerts on a mass is directly proportional to its extension and always acts to reduce this extension:

$$f=-k\times\Delta,$$

where f is the spring force, k is a positive quantity called the force constant of the spring, and Δ is the change in length (or extension) of the spring. Hence, it will be noted that the spring force f provided by extension springs 136 and 138 increases as bottom rail 116 is lowered because lowering bottom rail 116 results in further extension of springs 136 and 138. As persons skilled in the art will recognize, this provides a force curve that is precisely opposite what would be ideal because springs 136 and 138 are required to do less work as bottom rail 116 is lowered as a result of less slats being accumulated thereon.

Accordingly, to properly balance blind system 110 it may be desirable or necessary to employ various well known devices or techniques for increasing or decreasing the amount of frictional forces. For example, the components of blind system 110 can be made from certain materials having known high or low (as appropriate) frictional coefficients, or lubricants can be used to alter the natural frictional coefficients of the materials. In addition, blind system 110 may be provided with features that are specifically designed for increasing or decreasing the amount of friction in blind system 110. For example, friction can be reduced by positioning a pair of guides 156 and 158 within head rail 114 adjacent openings 124 and 126, respectively, to assist the sliding movement of each cord 120, 122 as it transitions from its generally vertical orientation below head rail 114 to its generally horizontal orientation within head rail 114. Guides 156 and 158 may take the form of simple rods, small rollers or any other appropriate form.

Figure 4:
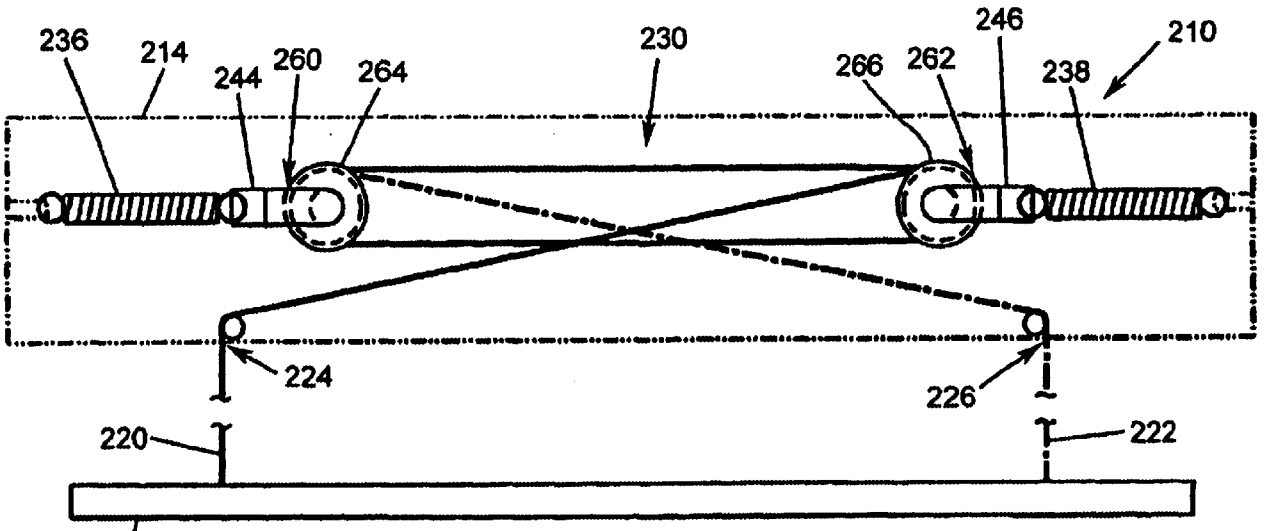
FIG. 4 is a front elevation schematic representation of a venetian blind and slat lifting mechanism in accordance a second embodiment of the present invention.
Figure 5:
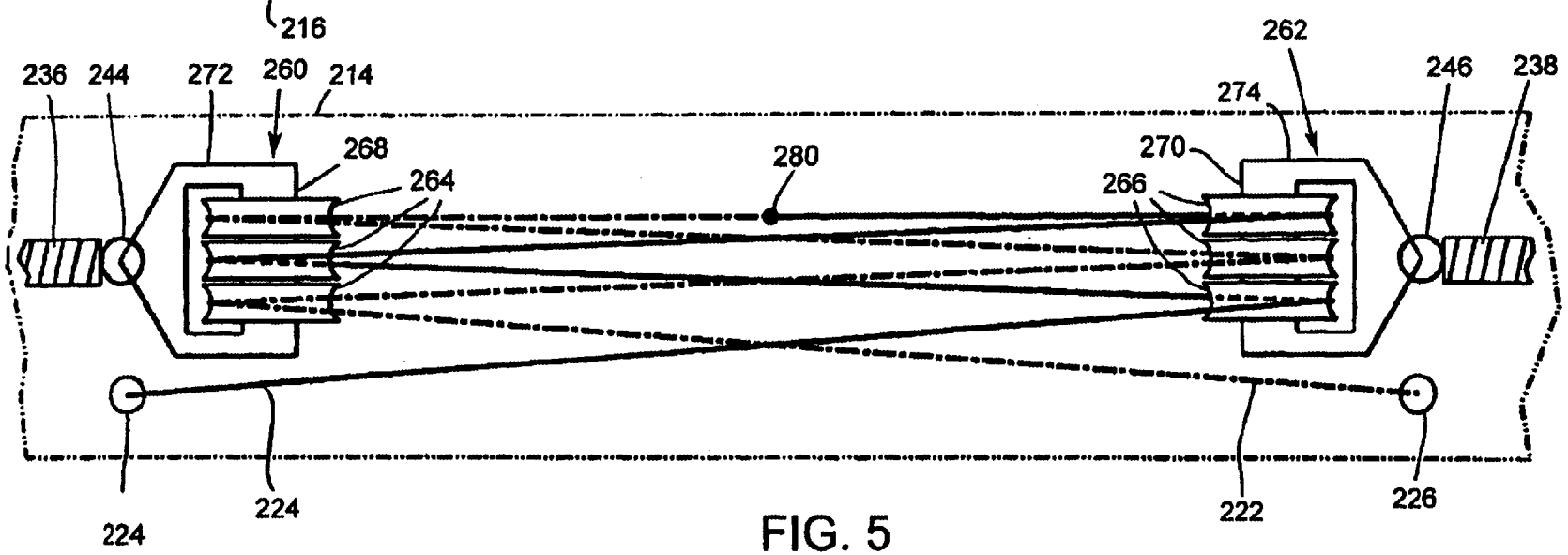
FIG. 5 is a top plan schematic representation of the Venetian blind and lifting mechanism shown in FIG. 4.

Referring now to FIGS. 4 and 5, a second embodiment of a blind system 210 is shown. For brevity, the description of blind system 210 will be generally limited to its differences relative to blind system 110. For convenience, elements of blind system 210 that are substantially similar to corresponding elements of blind system 110 will be identified by the same reference numerals but preceded by a "2" instead of a "1".

Blind system 210 includes a plurality of slats extending between a head rail 214 and a bottom rail 216. A pair of lifting cords 220 and 222 extend upwardly from bottom rail 216 through the slats and into head rail 214 via a pair of openings 224 and 226, respectively, to a spring motor and storage unit 230.

Blind system 210 differs from blind system 110 primarily that each cord 220, 222 is looped multiple times in spring motor and storage unit 230. As explained in detail below, each loop of cord 220, 222 in spring motor and storage unit 230 will act as a reducer, that is, any change in the height of blind system 210 will produce a correspondingly smaller change in the length of each spring 236, 238 due to the multiple cord loops. This can be particularly advantageous in blind systems that have relatively narrow widths in comparison to the height or length of the blind.

Blind system 210 also differs from blind system 110 in that the free end 244, 246 of each spring 236, 238 includes a block and tackle (or pulley) 260, 262 for reducing the friction in blind system 210. As seen in FIG. 5, each block and tackle 260, 262 includes one or more rollers 264, 266 mounted for rotation about an axle 268, 270 formed in a generally flat plate 272, 274. Each axle 268, 270 preferably extends generally transversely to the central axes of the head rail and bottom rails. Each roller 264, 266 may include one or more grooves so that the multiple cord loops remain separated from each other during movement of bottom rail 216. This not only helps prevent cord entanglement but also reduces the friction in blind system 210 because the cords do not have to slide over one another. Cords 220 and 222 may be connected to one another in head rail 214 or tied to a post or anchor 280 secured to an inner surface of head rail 214.

In the embodiment of FIGS. 4 and 5, each cord 220, 222 is looped a total of three times in spring motor and storage unit 230. Specifically, cord 220 is looped twice about free end 246 and once about free end 244, and cord 222 is looped twice about free end 244 and once about free end 246. Hence, any change in the height of blind system 210 resulting from vertical movement of bottom rail 216 will cause about a corresponding change in the length of each spring 236, 238. In particular, this relationship can be described by the following equation:

$$H_1-H_2=2\times N\times(L_1-L_2), \quad (2)$$

where N is the total number of times that each cord 220, 222 is looped over the free ends 244 and 246 in spring motor and storage unit 230. Thus, the length of each extension spring 136, 138 will change about ½n times the amount of any change in the height of blind system 110.

Figure 6:
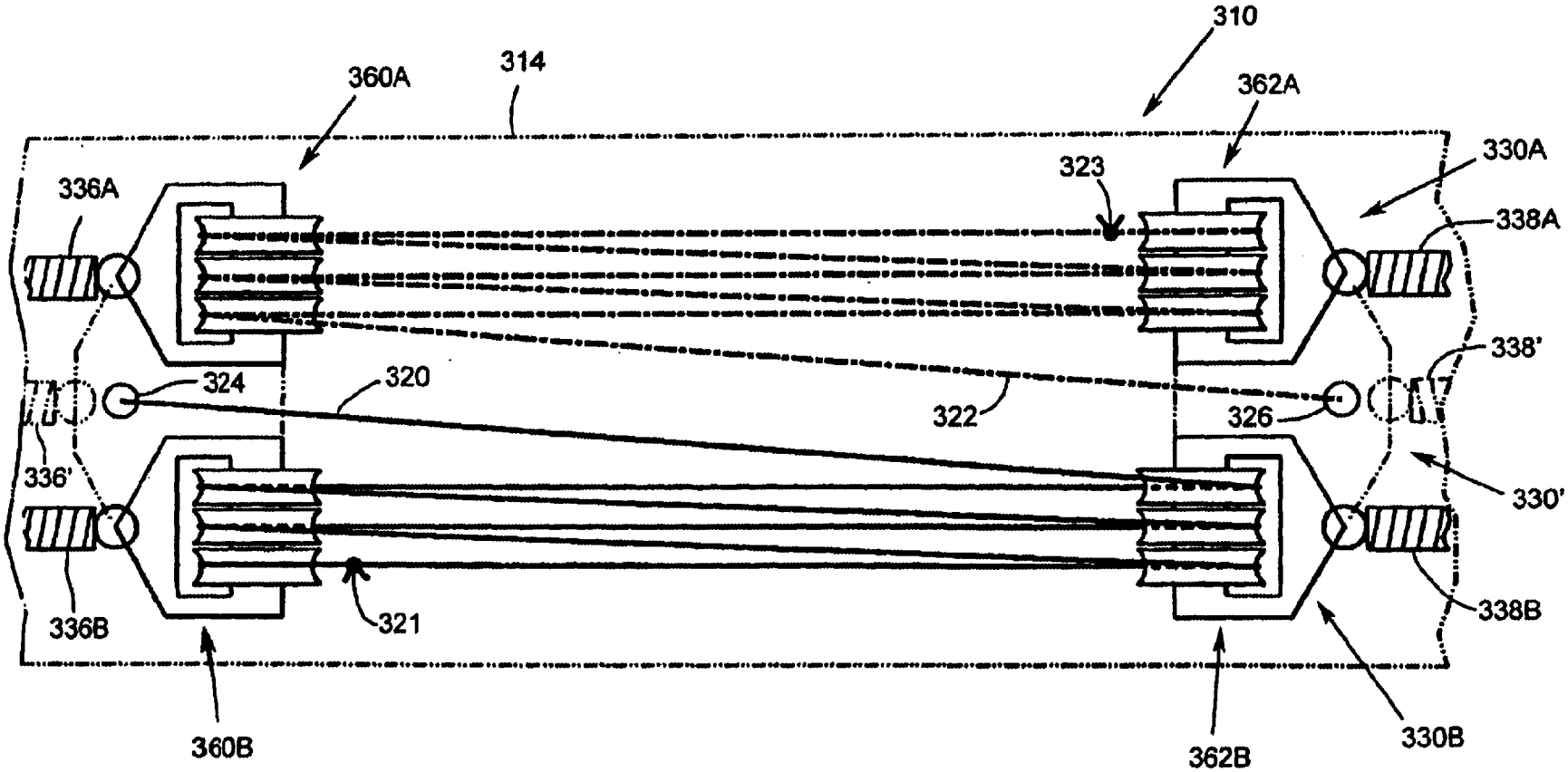
FIG. 6 is a top plan schematic representation of a Venetian blind and slat lifting mechanism in accordance a third embodiment of the present invention.

Referring now to FIG. 6, a third embodiment of a blind system 310 is shown. For brevity, the description of blind system 310 will be generally limited to its differences relative to blind system 210. For convenience, elements of blind system 310 that are substantially similar to corresponding elements of blind system 210 will be identified by the same reference numerals but preceded by a "3" instead of a "2".

Blind system 310 includes a plurality of slats extending between a head rail 314 and a bottom rail. A pair of lifting cords 320 and 322 extend upwardly from the bottom rail through the slats and into head rail 314 via a pair of openings 324 and 326.

Blind system 310 differs from blind system 210 primarily in that cords 320 and 322 are looped around separate rollers 364A, 366A and 364B, 366B, respectively, rather than shared rollers. In addition, each cord 320, 322 is tied to itself in a knot 321, 323, respectively, rather than tied to the opposite cord. As shown by the solid lines in FIG. 6, each roller 364A, 366A, 364B, 366B may be individually mounted in head rail 414 by a separate extension spring 336A, 338A, 336B, 338B, respectively. Alternatively, rollers 364A, 366A and 364B, 366B may be mounted in head rail 414 by only two extension springs 336' and 338', respectively (see the phantom lines in FIG. 6).

In either case, cords 320 and 322 each loop around their respective rollers 364B, 366B and 364A, 366A a total of six times. Thus, the height of blind system 310 will change about six times as much as the length of each extension spring 336A, 338A, 336B, 338B (or 336', 338' in the alternative arrangement) when the bottom rail is moved vertically from one position to another. Once again, this relationship can be described by equation (2) described above.

Figure 7:
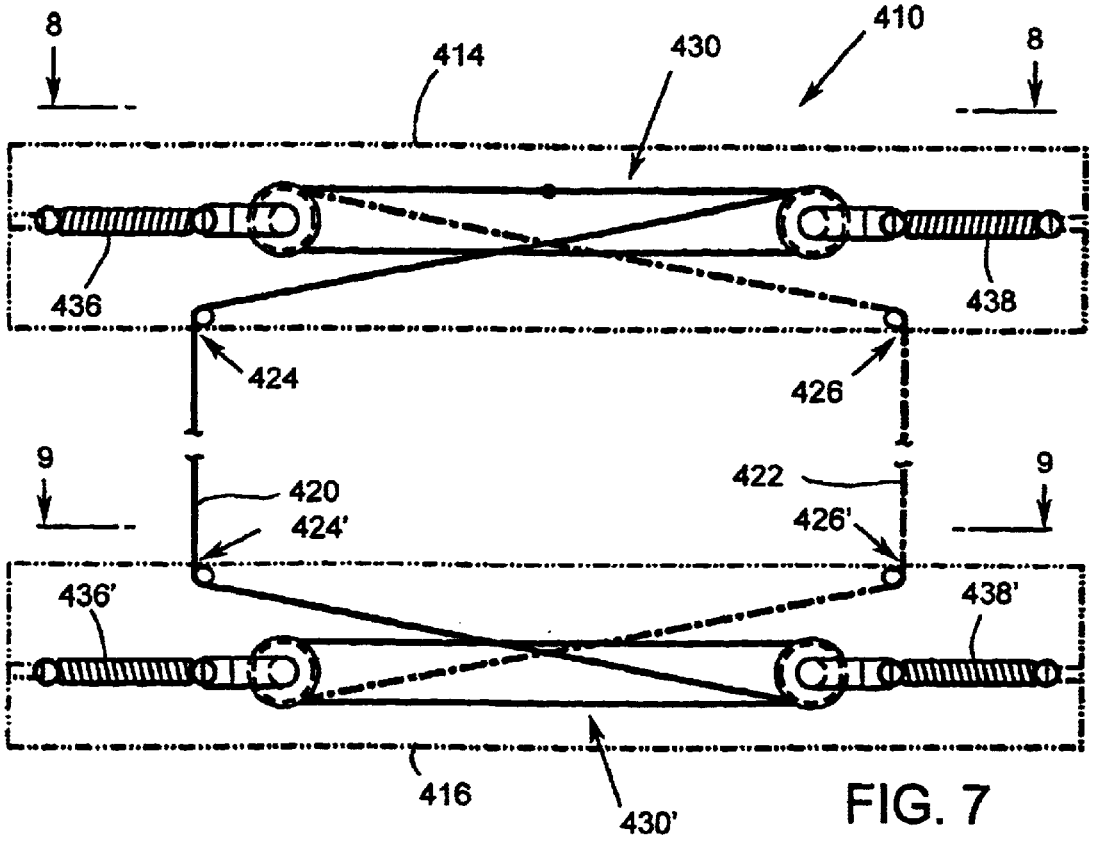
FIG. 7 is a front elevation schematic representation of a venetian blind and slat lifting mechanism in accordance a fourth embodiment of the present invention.
Figure 8:
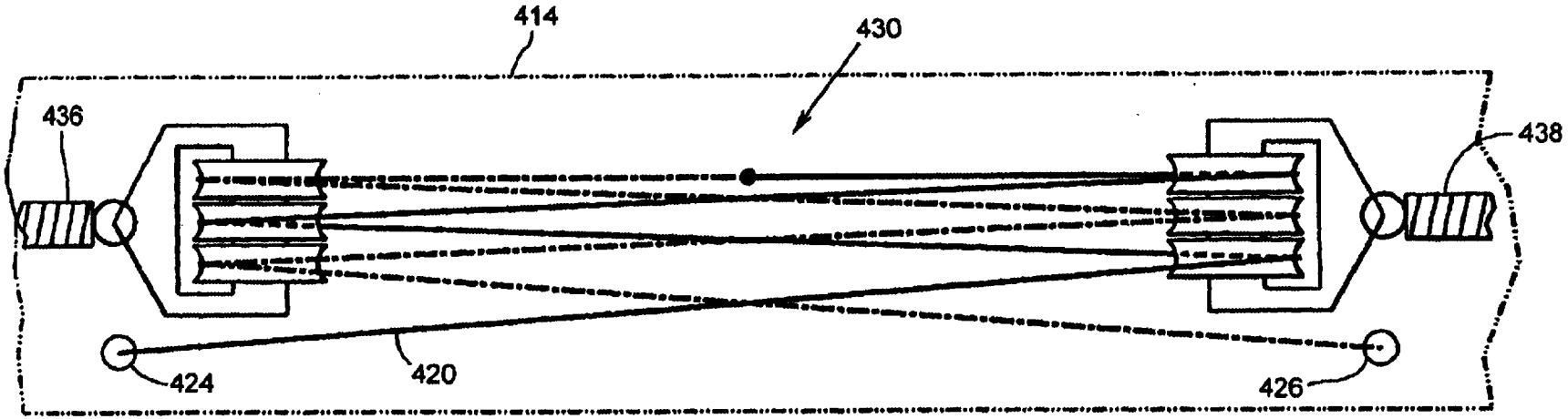
FIG. 8 is a top plan schematic representation of the venetian blind and lifting mechanism shown in FIG. 7 taken along the line 8—8.
Figure 9:
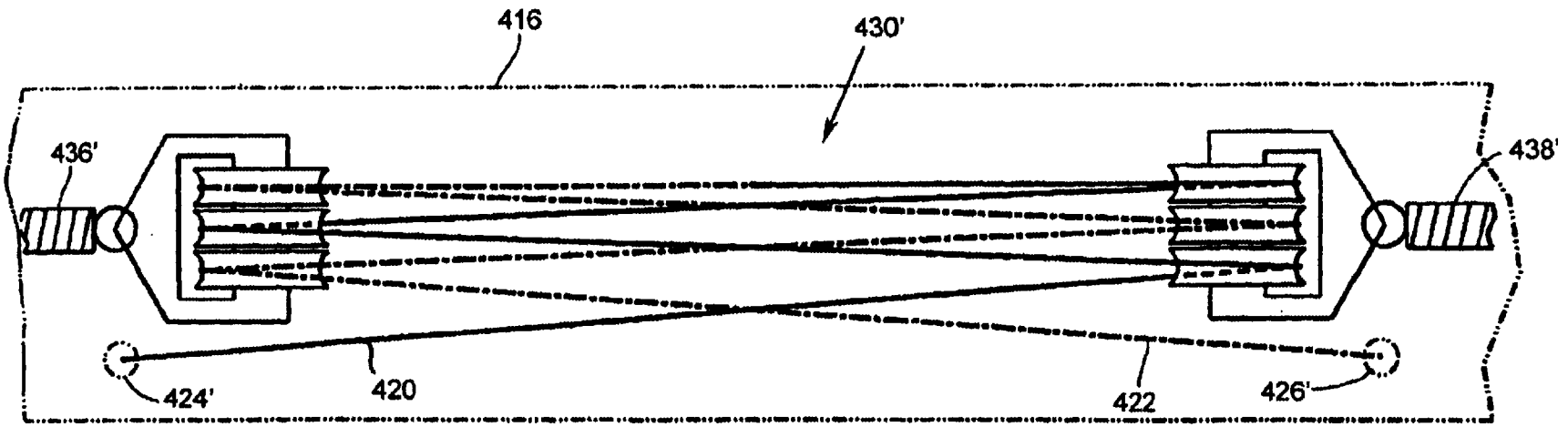
FIG. 9 is a top plan schematic representation of the venetian blind and lifting mechanism shown in FIG. 7 taken along the line 9—9.

Referring now to FIGS. 7–9, a fourth embodiment of a blind system 410 is shown. For brevity, the description of blind system 410 will be generally limited to its differences relative to blind system 210. For convenience, elements of blind system 410 that are substantially similar to corresponding elements of blind system 210 will be identified by the same reference numerals but preceded by a "4" instead of a "2".

Blind system 410 includes a plurality of slats extending between a head rail 414 and a bottom rail 416. A pair of lifting cords 420 and 422 extend upwardly from bottom rail 416 through the slats and into head rail 414 via a pair of openings 424 and 426 to a spring motor and storage unit 430.

Blind system 410 differs from blind system 210 primarily in that it includes an additional (lower) spring motor and storage unit 430' in bottom rail 416. In addition, each cord 420, 422 is not simply tied to bottom rail 416 but instead extends to lower spring motor and storage unit 430' via a pair of openings 424' and 426'.

In the embodiment of FIGS. 7–9, each cord 420, 422 makes a total of three loops in upper spring motor and storage unit 430 (see FIG. 8) and three loops in lower spring motor and storage unit 430' (see FIG. 9). Thus, each cord 420, 422 makes a combined total of six loops in upper and lower spring motor and storage units 430 and 430'. Accordingly, the height of blind system 410 will change about twelve times as much as the length of each spring 436, 438 and 436', 438' when bottom rail 416 is moved vertically from one position to another. Once again, this relationship can be described by equation (2) described above.

Figure 10:
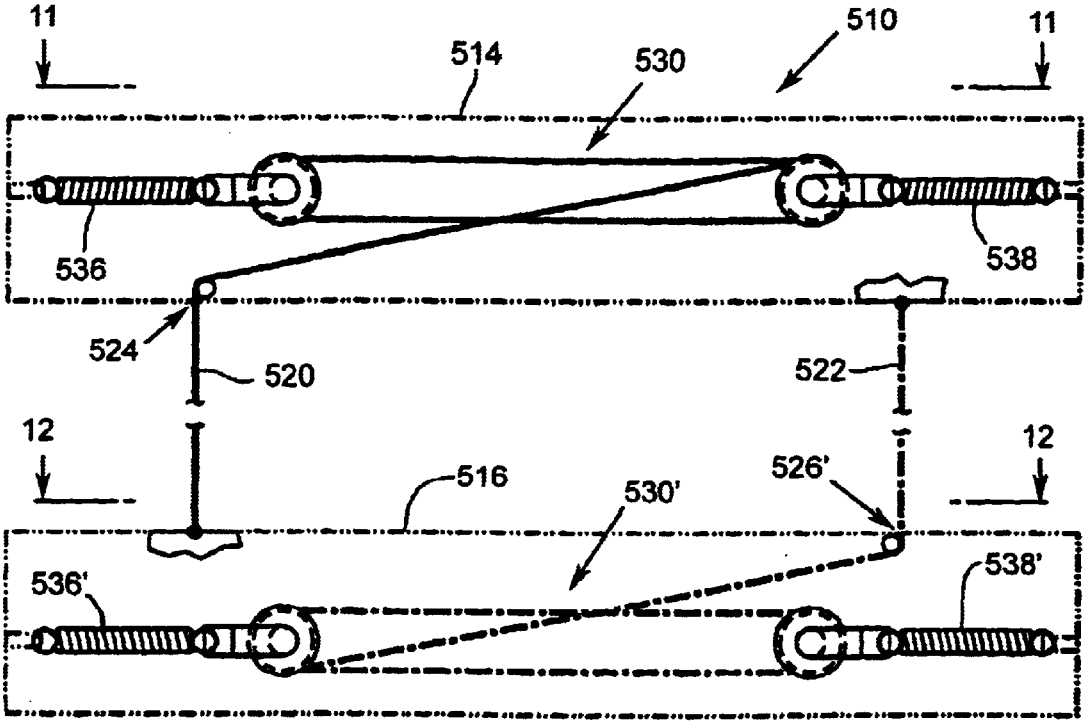
FIG. 10 is a front elevation schematic representation of a venetian blind and slat lifting mechanism in accordance a fifth embodiment of the present invention.
Figure 11:
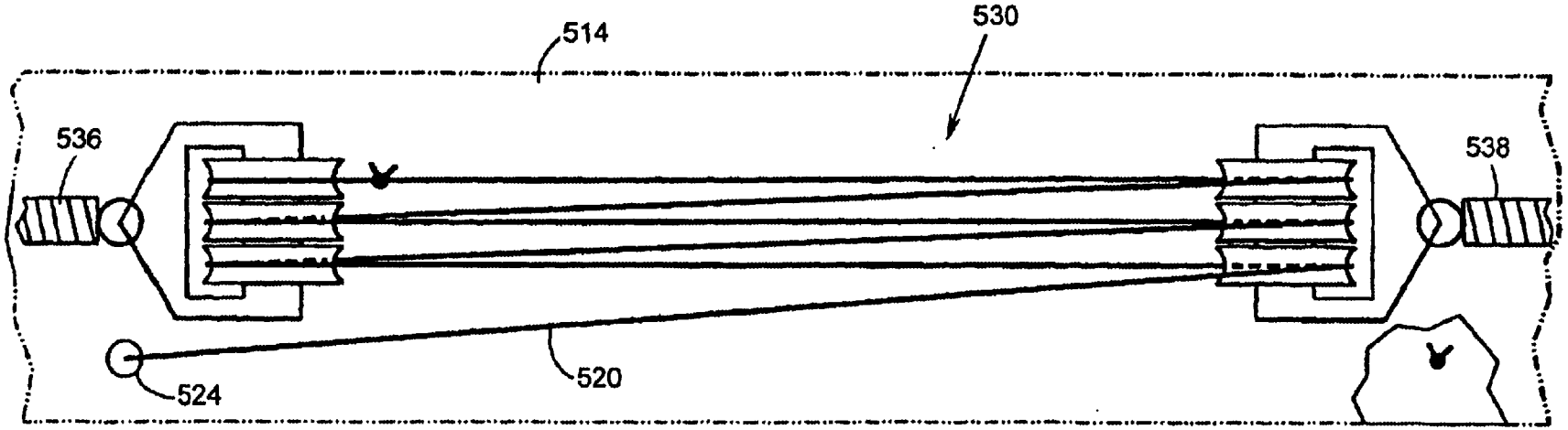
FIG. 11 is a top plan schematic representation of the venetian blind and lifting mechanism shown in FIG. 10 taken along the line 11—11.
Figure 12:
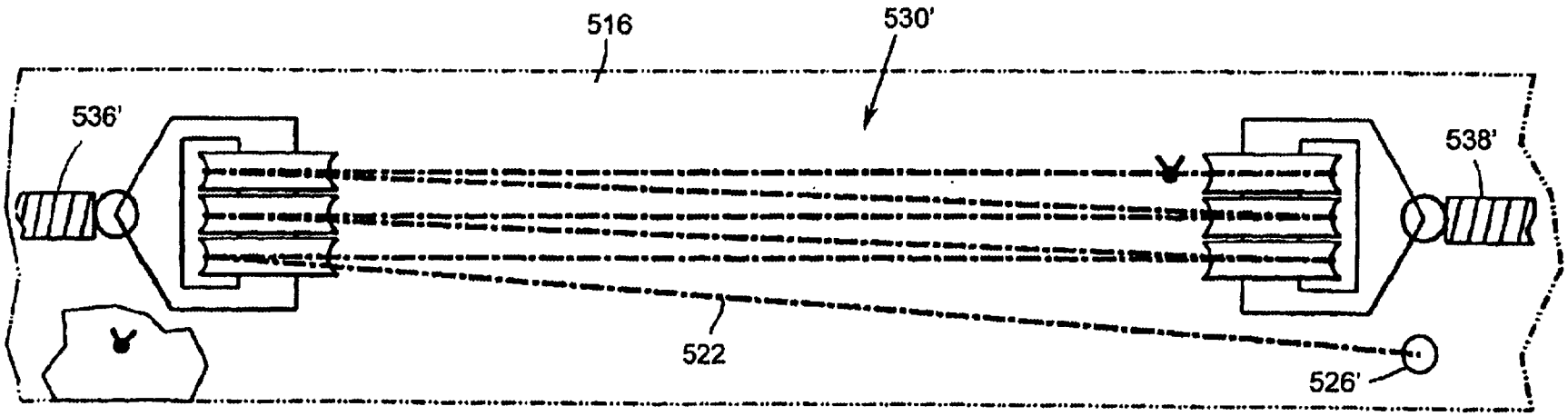
FIG. 12 is a top plan schematic representation of the venetian blind and lifting mechanism shown in FIG. 10 taken along the line 12—12.

Referring now to FIGS. 10–12, a fourth embodiment of a blind system 510 is shown. For brevity, the description of blind system 510 will be generally limited to its differences relative to blind system 410. For convenience, elements of blind system 510 that are substantially similar to corresponding elements of blind system 410 will be identified by the same reference numerals but preceded by a "5" instead of a "4".

Similar to all the previous embodiments, bind system 510 includes a plurality of slats extending between a head rail 514 and a bottom rail 516. Blind system 510 differs from the previous embodiments, however, in that it includes a pair of lifting cords that extend in opposite directions to each other. Specifically, one lifting cord 520 extends upwardly from bottom rail 516 through the slats and into head rail 514 via an opening 524 to an upper spring motor and storage unit 530. The other lifting cord 522 extends downwardly from upper rail 514 through the slats and into bottom rail 516 via an opening 526' to a lower spring motor and storage unit 530'.

In the embodiment of FIGS. 10–12, cord 520 makes a total of six loops in upper spring motor and storage unit 530 (see FIG. 11), and cord 522 makes a total of six loops in lower spring motor and storage unit 530' (see FIG. 12). Accordingly, the height of blind system 510 will change about twelve times as much as the length of each spring 536, 536', and 538, 538' when bottom rail 516 is moved vertically from one position to another. Once again, this relationship can be described by equation (2) described above.

As explained above, persons skilled in the art may find it desirable or necessary to employ devices for altering the amount of friction in a blind system constructed in accordance with the present invention. One such device for substantially increasing the amount of friction is shown in the embodiment of FIGS. 13–15. In FIG. 13, a bottom rail 616 of a blind system 610 is shown with a lower spring motor and storage unit 630'. Lower spring motor and storage unit 630' receives a pair of lift cords 620, 622.

Blind system 610 differs from all the above-described blind systems in that it further includes a braking device 682 associated with cord 620. As shown in FIG. 14, braking device 682 has a case 684 that is provided with a pair of cord holes 686 and 688 aligned with each other on opposite sides of case 684. Case 684 is also provided with a bore 690 configured to receive a compression spring 692 and a retaining member 694. Spring 692 and retaining member 694 are situated in bore 690 such that spring 692 naturally biases retaining member 694 out of bore 690. Lift cord 620 passes through cord holes 686 and 688 of case 684 and also through a cord hole 696 formed in retaining member 694. As shown in FIG. 14, when retaining member 694 is naturally urged by spring 692, cord hole 696 of retaining member 694 and cord holes 686 and 688 of case 684 are located alternately to bring about the clamping effect that acts on lift cord 620. By means of the clamping force and the resulting frictional resistance of braking device 682, the rewinding force of spring motor and storage means 630' is overcome. As a result, bottom rail 616 can be located at any desired position without inadvertent rewinding.

Now referring to FIG. 15, when retaining member 694 is pushed deeper into bore 690 by an external force, cord hole 696 of retaining member 694 moves substantially into alignment with cord holes 686 and 688 of case 684. As a result, the frictional forces acting on cord 620 are substantially reduced, whereby bottom rail 616 can be readily moved to a new position.

It is important to note that the above-described preferred embodiments of the blind system are illustrative only. Although the invention has been described in conjunction with specific embodiments thereof, those skilled in the art will appreciate that numerous modifications are possible without materially departing from the novel teachings and advantages of the subject matter described herein. For example, although the blind system is described above with each spring motor and storage unit including a pair of extension springs, the spring motor and storage unit could employ as few as one extension spring or more than two extension springs. In addition, although the linear springs of each spring motor and storage unit are described as extension (or tension) springs, those skilled in the art would understand that the extension springs could be replaced with compression springs by making relatively simple modifications to the existing structures. For example, the inner ends of the compression springs could be secured to fixed anchors in the head rail or bottom rail and the outer ends of the compression springs could be allowed to move freely toward and away from the fixed ends as the bottom rail is moved vertically. Thus, the term "linear" spring is intended to encompass both compression springs and extension springs. Accordingly, these and all other such modifications are intended to be included within the scope of the present invention. Other substitutions, modifications, changes and omissions may be made in the design, operating conditions and arrangement of the preferred and other exemplary embodiments without departing from the spirit of the present invention.

What is claimed is:

1. A window covering system, comprising:

a window covering material located between a head rail and a bottom rail, the bottom rail being connected to the head rail by a pair of lifting cords; and a pair of first biasing devices located within one of the head rail and the bottom rail, the first biasing devices having fixed ends operatively secured to the head rail or bottom rail and free ends that are free to move in a direction along an axis of the head rail or bottom rail, wherein the pair lifting cords are operatively connected to the free ends of the first biasing devices so that movement of the bottom rail in a vertical direction causes a corresponding movement in the free ends along the direction of the axis of the head rail or bottom rail, and wherein the free end of each first biasing device includes a roller, and at least one of the cords is operatively connected to each roller.

2. The window covering system of claim 1, wherein each roller includes one or more cord receiving grooves.

3. A window covering system, comprising:

a window covering material located between a head rail and a bottom rail, the bottom rail being connected to the head rail by a pair of lifting cords;

a pair of first biasing devices located within one of the head rail and the bottom rail, the first biasing devices having fixed ends operatively secured to the head rail or bottom rail and free ends that are free to move in a direction along an axis of the head rail or bottom rail, wherein the pair lifting cords are operatively connected to the free end of the first biasing devices so that movement of the bottom rail in a vertical direction causes a corresponding movement in the free ends along the direction of the axis of the head rail or bottom rail; and a pair of second biasing devices located in one of the head rail and the bottom rail, each of the second biasing devices being elongated in the direction of the head rail and the bottom rail and having a fixed end and a free end, and at least one of the lifting cords being operatively connected to the free end of at least one of the second biasing devices so that movement of the bottom rail causes a corresponding movement in the free end of the second biasing device, and wherein the first biasing devices are located in the head rail and the second biasing devices are located in the bottom rail.

4. A window covering system, comprising:

a window covering material located between a head rail and a bottom rail, the bottom rail being connected to the head rail by a pair of lifting cords; and a pair of first biasing devices located within one of the head rail and the bottom rail, the first biasing devices having fixed ends operatively secured to the head rail or bottom rail and free ends that are free to move in a direction along an axis of the head rail or bottom rail, wherein the pair lifting cords are operatively connected to the free ends of the first biasing devices so that movement of the bottom rail in a vertical direction causes a corresponding movement in the free ends along the direction of the axis of the head rail or bottom rail, wherein the window covering system has a variable height and each first biasing device has a variable length, the height and length varying in relation to each other during movement of the bottom rail from a first position to a second position in a predefined manner, and wherein the height of the window covering system varies in relation to the length of each first biasing device according to the following equation, $$H_1-H_2=2\times N\times(L_1-L_2),$$

wherein $L_1$ is the length of each first biasing device when the bottom rail is in the first position, $L_2$ is the length of each first biasing device when the bottom rail is in the second position, $H_1$ is the height of the window covering system when the bottom rail is in the first position, $H_2$ is the height of the window covering system when the bottom rail is in the second position, and N is the total number of times that each cord is looped around the free ends of the biasing devices.

5. A window covering system, comprising:

a window covering material located between a head rail and a bottom rail, the bottom rail being connected to the head rail by at least one lifting cord; and a pair of first linear springs located in one of the head rail and the bottom rail, the first linear springs having first ends anchored to an inner surface of the head rail or the bottom rail and second ends that are free to move within the head rail or the bottom rail, wherein the free end of each linear spring includes a pulley, and at least one of the cords is looped around each pulley, and wherein each pulley includes at least one roller with one or more cord receiving grooves, wherein at least one lifting cords is operatively connected to the free end of at least one of the linear springs so that movement of the bottom rail causes a corresponding movement in the second end of the linear spring.

6. A window covering system, comprising:

a window covering material located between a head rail and a bottom rail, the bottom rail being connected to the head rail by at least one lifting cord;

a pair of first linear springs located in one of the head rail and the bottom rail, the first linear springs having first ends anchored to an inner surface of the head rail or the bottom rail and second ends that are free to move within the head rail or the bottom rail;

a pair of second linear springs located in one of the head rail and the bottom rail, the second linear springs having first ends anchored to an inner surface of the head rail or the bottom rail and second ends that are free to move within the head rail or the bottom rail, wherein at least one lifting cords is operatively connected to the free end of at least one of the linear springs so that movement of the bottom rail causes a corresponding movement in the second end of the linear spring.

7. The window covering system of claim 6, wherein the first and second linear springs are located together in the head rail or bottom rail.

8. The window covering system of claim 6, wherein the first linear springs are located in the head rail and the second linear springs are located in the bottom rail.

9. A method for balancing a covering system, the window covering system comprising a window covering material located between a head rail and a bottom rail, the bottom connected to the head rail by at least one lifting cord, the method comprising:

operatively connecting a fixed end of a first linearly shaped spring to a non-movable anchor in one of the head rail and the bottom rail so that the fixed end remains stationary, an opposite free end of the linearly shaped spring being free to move toward and away from the fixed end;

attaching a pulley to the free end of the first linearly shaped spring; and looping at least one of the lifting cords one or more times around the pulley so that movement of the bottom rail in a vertical direction causes a correspondingly smaller movement in the free end of the second linearly shaped spring in a direction along an axis of the head rail or bottom rail.

10. A window covering system, comprising:

a head rail having a first end wall, a second end wall, a first opening disposed proximate the first end wall and a second opening disposed proximate the second end wall;

a bottom rail;

a window covering material disposed between the head rail and the bottom rail;

a first biasing member disposed within the head rail and having a first fixed end connected to the first end wall of the head rail, and a first free end;

a second biasing member disposed within the head rail and having a second fixed end connected to the second end wall of the head rail, and a second free end;

a first cord having a first end connected to the bottom rail, the first cord extending upwardly through the first opening, extending from the first opening toward the second biasing member and being slidably coupled to the second free end of the second biasing member, and extending from the second biasing member toward the first biasing member; and a second cord having a first end connected to the bottom rail, the second cord extending upwardly through the second opening, extending from the second opening toward the first biasing member and being slidably coupled to the first free end of the first biasing member, and extending from the first biasing member toward the second biasing member, wherein movement of the bottom rail away from the head rail causes a corresponding extension of the first and second biasing members.

11. The window covering system of claim 10, further comprising:

a first guide mounted in the headrail proximate the first opening, wherein a portion of the first cord extending between the first opening and the second biasing member passes over the first pulley; and a second guide mounted in the headrail proximate the second opening, wherein a portion of the second cord extending between the second opening and first biasing member passes over the second guide.

12. The window covering system of claim 10, wherein a second end of the first cord is connected to a second end of the second cord.

13. The window covering system of claim 12, wherein the first cord and the second cord are formed together from a single unitary cord.

14. The window covering system of claim 10, wherein the head rail comprises an anchor connected to an inner surface of the head rail, and wherein a second end of the first cord and a second end of the second cord are connected to the anchor.

15. The window covering system of claim 10, comprising:

a first roller rotatably coupled to the first free end of the first biasing member, wherein the second cord is looped around the first roller; and a second roller rotatably coupled to the second free end of the second biasing member, wherein the first cord is looped around the second roller.

16. The window covering system of claim 15, wherein the first and the second cords are each looped around both the first roller and the second roller at least one time.

17. A window covering system, comprising:

a head rail having a first end wall, a second end wall, a first opening disposed proximate the first end wall and a second opening disposed proximate the second end wall;

a bottom rail having a third end wall, a fourth end wall, a third opening disposed proximate the third end wall and a fourth opening disposed proximate the fourth end wall;

a window covering material disposed between the head rail and the bottom rail;

a first biasing member disposed within the head rail and having a first fixed end connected to the first end wall of the head rail, and a first free end;

a second biasing member disposed within the head rail and having a second fixed end connected to the second end wall of the head rail, and a second free end;

a third biasing member disposed within the bottom rail and having a third fixed end connected to the third end wall of the bottom rail, and a third free end;

a second biasing member disposed within the head rail and having a second fixed end connected to the second end wall of the head rail and a fourth free end;

a first cord having a first end disposed within the bottom rail, the first cord slidably coupled to the fourth free end of the fourth biasing member, extending from the fourth biasing member toward the third opening, extending upwardly through the third opening and the first opening, extending from the first opening toward the second biasing member and being slidably coupled to the second free end of the second biasing member, and extending from the second biasing member toward the first biasing member; and a second cord having a first end disposed within the bottom rail, the second cord slidably coupled to the third free end of the third biasing member, extending from the third biasing member toward the fourth opening, extending upwardly through the fourth opening and the second opening, extending from the second opening toward the first biasing member and being slidably coupled to the first free end of the first biasing member, and extending from the first biasing member toward the second biasing member, wherein movement of the bottom rail away from the head rail causes a corresponding extension of the first, second, third and fourth biasing members.

18. The window covering system of claim 17, wherein the first end of the first cord is connected to the first end of the second cord, and a second end of the first cord disposed within the head rail is connected to a second end of the second cord.

19. The window covering system of claim 17, comprising:

a first roller rotatably coupled to the first free end of the first biasing member;

a second roller rotatably coupled to the second free end of the second biasing member;

a third roller rotatably coupled to the third free end of the third biasing member; and a fourth roller rotatably coupled to the fourth free end of the fourth biasing member, wherein the first cord is looped around the second roller and the fourth roller, and the second cord is looped around the first roller and the third roller.

20. The window covering system of claim 19, wherein the first and the second cords are each looped around both the first roller and the second roller at least one time, and the first and second cords are each looped around both the third roller and the fourth roller at least one time.

21. A window covering system, comprising:

a head rail having a first end wall, a second end wall, and a first opening disposed proximate the first end wall;

a bottom rail having a third end wall, a fourth end wall, and a second opening disposed proximate the fourth end wall;

a window covering material disposed between the head rail and the bottom rail;

a first biasing member disposed within the head rail and having a first fixed end connected to the first end wall of the head rail, and a first free end;

a second biasing member disposed within the head rail and having a second fixed end connected to the second end wall of the head rail, and a second free end;

a third biasing member disposed within the bottom rail and having a third fixed end connected to the third end wall of the bottom rail, and a third free end;

a second biasing member disposed within the head rail and having a second fixed end connected to the second end wall of the head rail and a fourth free end;

a first cord having a first end connected to the bottom rail, extending upwardly through the first opening, extending from the first opening toward the second biasing member and being slidably coupled to the second free end of the second biasing member, extending from the second biasing member toward the first biasing member and being slidably coupled to the first biasing member, and wherein a second end of the first cord is connected to a portion of the first cord disposed between the first and the second biasing members; and a second cord having a first end connected to the top rail, extending downwardly through the second opening, extending from the second opening toward the third biasing member and being slidably coupled to the third free end of the third biasing member, extending from the third biasing member toward the fourth biasing member and being slidably coupled to the fourth biasing member, and wherein a second end of the second cord is connected to a portion of the second cord disposed between the third and the fourth biasing members, wherein movement of the bottom rail away from the head rail causes a corresponding extension of the first, second, third and fourth biasing members.

22. The window covering system of claim 21, comprising:

a first roller rotatably coupled to the first free end of the first biasing member;

a second roller rotatably coupled to the second free end of the second biasing member;

a third roller rotatably coupled to the third free end of the third biasing member; and a fourth roller rotatably coupled to the fourth free end of the fourth biasing member, wherein the first cord is looped around both the first roller and the second roller at least one time, and the second cord is looped around the third roller and the fourth roller at least one time.

* * * * *